US010252521B2

(12) United States Patent
Akama et al.

(10) Patent No.: US 10,252,521 B2
(45) Date of Patent: Apr. 9, 2019

(54) LIQUID DISCHARGE HEAD

(71) Applicant: CANON KABUSHIKI KAISHA, Tokyo (JP)

(72) Inventors: Yuichiro Akama, Tokyo (JP); Yuji Tamaru, Yokohama (JP); Naoko Tsujiuchi, Kawasaki (JP); Sayaka Seki, Tokyo (JP); Yasuaki Kitayama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/658,237

(22) Filed: Jul. 24, 2017

(65) Prior Publication Data

US 2018/0029358 A1 Feb. 1, 2018

(30) Foreign Application Priority Data

Jul. 26, 2016 (JP) ..... 2016-146274

(51) Int. Cl.
*B41J 2/045* (2006.01)
*B41J 2/14* (2006.01)
(Continued)

(52) U.S. Cl.
CPC ..... *B41J 2/04541* (2013.01); *B41J 2/0458* (2013.01); *B41J 2/04581* (2013.01);
(Continued)

(58) Field of Classification Search
CPC ..... H01L 2924/12035; H01L 27/0248; H01L 29/866; B41J 2/04541; B41J 2/04515; B41J 2/04548; B41J 2/0457; B41J 2/375
See application file for complete search history.

(56) References Cited

U.S. PATENT DOCUMENTS 4,905,119 A * 2/1990 Webb ..... H02H 9/04 361/111
5,371,530 A * 12/1994 Hawkins ..... B41J 2/04515 347/57

(Continued)

FOREIGN PATENT DOCUMENTS

JP 2013-184420 A 9/2013

OTHER PUBLICATIONS

Machine Translation JP2013-184420 retrieved Jun. 20, 2018; from: https://dossier1.j-platpat.inpit.go.jp/cgi-bin/tran_web_cgi_ejje?u=http://dossier1.j-platpat.inpit.go.jp/tri/translation.*

*Primary Examiner* — John Zimmermann
(74) *Attorney, Agent, or Firm* — Canon U.S.A., Inc. IP Division

(57) ABSTRACT

A liquid discharge head includes a recording element substrate including energy generating elements configured to generate energy for discharging liquid and a driving circuit configured to drive the energy generating elements, and a wiring unit including a plurality of connection terminals for connection with the main body side and electrically connected to the recording element substrate. In the wiring unit, wiring lines are respectively connected to the plurality of connection terminals, and a functional element configured to regulate an applied voltage to a predetermined voltage or less is provided between at least one signal wiring line connected to the driving circuit and used to transmit a signal for driving the energy generating element among the wiring lines and the wiring line having a relatively larger electric capacitance than that of the signal wiring line.

11 Claims, 7 Drawing Sheets

(51) Int. Cl.
*B41J 2/175* (2006.01)
*B41J 29/38* (2006.01)

(52) U.S. Cl.
CPC ..... *B41J 2/1433* (2013.01); *B41J 2/1752* (2013.01); *B41J 2/1753* (2013.01); *B41J 2/17553* (2013.01); *B41J 29/38* (2013.01); *B41J 2002/14491* (2013.01)

(56) References Cited

U.S. PATENT DOCUMENTS

| | | | | | |
|---|---|---|---|---|---|
| 6,126,261 | A * | 10/2000 | Yamanaka | B41J 2/04541 | 347/12 |
| 2001/0045967 | A1 * | 11/2001 | Hayasaki | B41J 2/04541 | 347/9 |
| 2003/0112297 | A1 * | 6/2003 | Hiratsuka | B41J 2/04541 | 347/58 |
| 2005/0225614 | A1 * | 10/2005 | Oomura | B41J 2/17566 | 347/86 |
| 2013/0334562 | A1 * | 12/2013 | Niide | H01L 33/44 | 257/99 |

* cited by examiner

LIQUID DISCHARGE HEAD

BACKGROUND OF THE INVENTION

Field of the Invention

The present disclosure relates to a liquid discharge head mounted on a liquid discharge apparatus, and more particularly, to a liquid discharge head having a function of preventing destruction caused by an electrostatic surge.

Description of the Related Art

In a liquid discharge apparatus that discharges liquid onto a recording medium to perform recording, a liquid discharge head including a discharge port for discharging liquid is provided The liquid discharge head is provided with energy generating elements for generating energy for discharging liquid, and each of the energy generating elements includes a heating resistance element or a piezoelectric element driven by an electric signal, for example. The energy generating elements are integrated on a recording element substrate including a semiconductor substrate, and a wiring line electrically connected to each of the energy generating elements is also formed on the recording element substrate. The recording element substrate may be provided with a driving circuit for driving each of the energy generating elements according to record data supplied from the liquid discharge apparatus.

In the liquid discharge head, the energy generating elements and other circuit elements may be destroyed caused by electrostatic discharge, which is a problem. As a measure against such electrostatic breakdown, Japanese Patent Application Laid-Open No. 2013-184420 discusses providing a functional element for regulating voltage to a predetermined value or less between a power source wiring line and another wiring line (e.g., a grounding wiring line) having a large electric capacitance in a contact substrate in a liquid discharge head. The contact substrate is provided in the liquid discharge head to receive each signal used for driving from a main body of a liquid discharge apparatus, and is connected to a recording element substrate via a wiring member. When the functional element is provided, even if a high-voltage electrostatic surge is applied to the power source wiring line, a surge current can be released to the wiring line having a large electrical capacitance, so that the power source wiring line in the recording element substrate can be protected. The electrical capacitance means a capability to electrostatically store a charge as an isolated conductor. The measure discussed in Japanese Patent Application Laid-Open No. 2013-184420 is more effective for a wiring line at a stable potential such as a power source wiring line for driving an energy generating element or a power source wiring line to a driving circuit.

This measure is effective for a case where the surge current from the power source wiring line is released to a wiring line at a reference potential having a large parasitic capacitance.

The measure discussed in Japanese Patent Application Laid-Open No. 2013-184420 is to connect the functional element between the power source wiring line at a relatively stable potential and, for example, the grounding wiring line, and implements protection when an electrostatic surge is applied to the power source wiring line. However, in this measure, when an electrostatic surge having a higher voltage is applied to a signal wiring line used for driving, the energy generating element and the driving circuit may be damaged. When the functional element for releasing an electrostatic surge is connected to a wiring line, a parasitic capacitance of the wiring line increases, so that a signal to be propagated on the wiring line is delayed. Thus, a functional element for protection from an electrostatic surge cannot be connected to a signal wiring line requiring high responsiveness.

SUMMARY OF THE INVENTION

The present disclosure is directed to a liquid discharge head capable of restraining damages even when a high-voltage electrostatic surge is applied to each signal wiring line used for driving.

According to an aspect of the present disclosure, a liquid discharge head includes a recording element substrate including an energy generating element configured to generate energy for discharging liquid and a driving circuit configured to drive the energy generating element, and a wiring unit including a plurality of connection terminals for establishing electrical connection with a liquid discharge apparatus including the liquid discharge head and electrically connected to the recording element substrate, wherein in the wiring unit, wiring lines are respectively connected with the plurality of connection terminals, and a functional element configured to regulate an applied voltage to a predetermined voltage or less is connected between at least one of signal wiring lines connected to the driving circuit and used to transmit a signal for driving the energy generating element among the wiring lines and a wiring line having a relatively larger electric capacitance than that of the signal wiring line.

Further features of the present disclosure will become apparent from the following description of exemplary embodiments with reference to the attached drawings.

DESCRIPTION OF THE EMBODIMENTS

Exemplary embodiments of the present disclosure will be described below with reference to the drawings. While a case where a liquid discharge apparatus is an ink jet recording apparatus that discharges recording liquid such as ink as liquid will be described below as an example, the present disclosure is not limited thereto.

Figure 1:
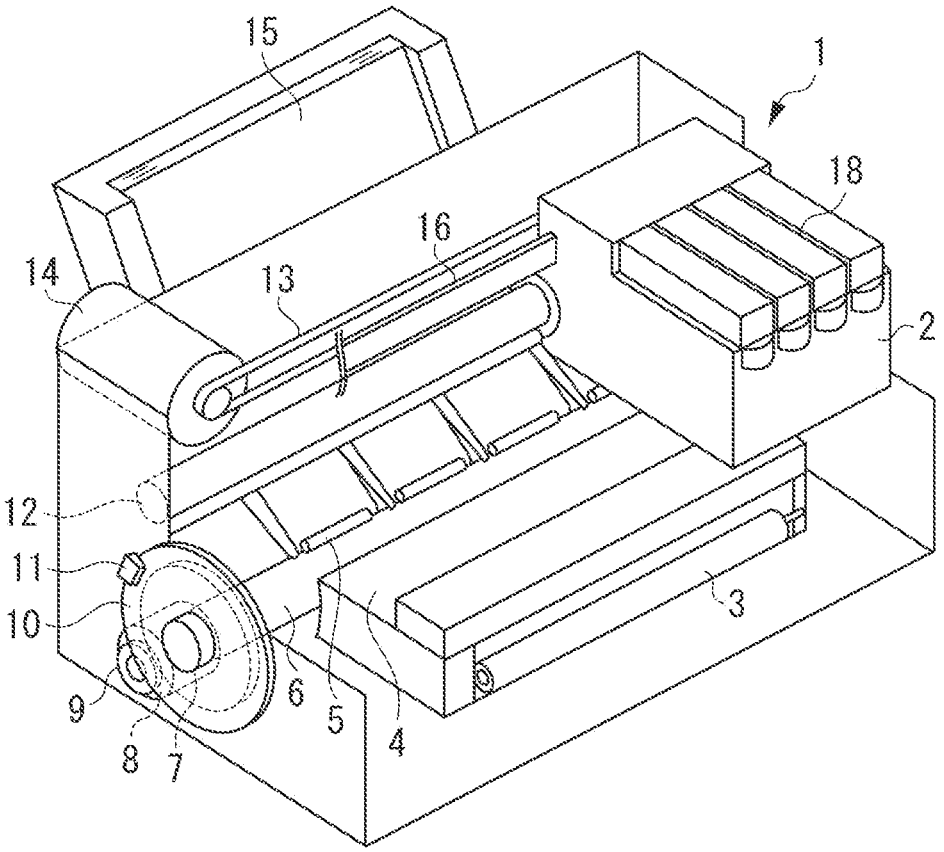
FIG. 1 is a perspective view illustrating an example of a configuration of a liquid discharge apparatus.

FIG. 1 illustrates a configuration of a liquid discharge apparatus 100 to which a liquid crystal discharge head 1 according to the present exemplary embodiment is applied. The liquid discharge head 1 includes a discharge port array including a plurality of discharge ports for discharging recording liquid, and is mounted on a carriage 2 in the liquid discharge apparatus. The liquid discharge head 1 can be mounted with tanks 18 storing the recording liquid. Four tanks 18 respectively corresponding to recording liquids in colors, i.e., yellow, magenta, cyan, and black are mounted on the liquid discharge head 1. The carriage 2 is fitted on a shaft 12 and moved in a scanning direction orthogonal to a direction in which a recording medium 15 is conveyed by receiving a driving force from a motor 14 via a belt 13. A carriage encoder 16 connected to the carriage 2 is detected by a carriage position sensor (not illustrated), so that a position of the carriage 2 can be detected. At the time of a recording operation for discharging the recording liquid from the liquid discharge head 1 to perform recording on the recording medium 15 such as paper, the recording medium 15 is conveyed by a paper feed roller 6 driven via drive gears 7 and 9 from a paper feed motor 8. There is also provided an auxiliary roller 5 for pressing the recording medium 15 to the paper feed roller 6. When a paper feed encoder 10 rotates in synchronization with the paper feed motor 8, and a sensor reads slits marked on the paper feed encoder 10, to detect a position of the recording medium 15, and feeds back the detected position to a recording operation.

Driving of the liquid discharge head 1 for discharging recording liquid from the discharge ports of the liquid discharge head 1, scanning of the carriage 2, and conveyance of the recording medium 15 are respectively synchronously controlled, to discharge the recording liquid. a predetermined position on the recording medium 15. The recording medium 15 recorded by the recording liquid discharged from the liquid discharge head 1 is conveyed outward from the liquid discharge apparatus 100 as the sheet discharge roller 3 provided in a discharge unit 4 rotates.

Figure 2:
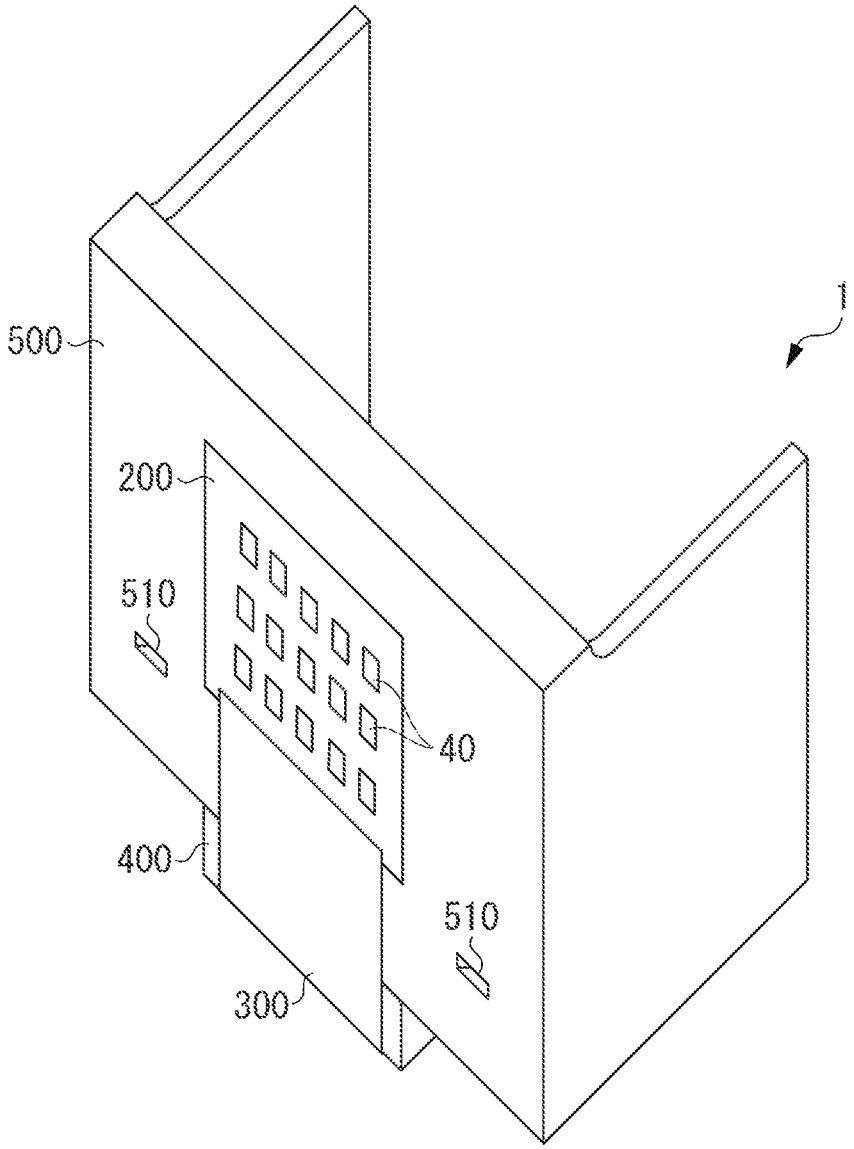
FIG. 2 is a perspective view illustrating an appearance of a liquid discharge head.

FIG. 2 illustrates an external configuration of the liquid discharge head 1. The liquid discharge head 1 includes a recording element substrate 21 (see FIG. 3) and a memory 25 (see FIG. 3) that holds information specific to the liquid discharge head 1. A main body control unit 28 (see FIG. 3) provided in a main body 101 of the liquid discharge apparatus 100 can perform driving control of the liquid discharge head 1 by reading the information in the memory 25 of the liquid discharge head 1 to select an optimum condition matching a characteristic of the liquid discharge head 1. The liquid discharge head 1 includes a case 500, a contact substrate 200 for electrically connecting with the main body 101 of the liquid discharge apparatus 100, a wiring member 300 joined to the contact substrate 200, and a recording element substrate unit 400. The recording element substrate unit 400 is provided with the recording element substrate 21. The recording element substrate 21 is joined to the wiring member 300, and is electrically connected to the contact substrate 200. The contact substrate 200 and the wiring member 300 constitute a wiring unit. The contact substrate 200, the wiring member 300, and the recording element substrate unit 400 are fixed to the case 500. The case 500 includes openings 510 into which protrusions on the tank side is fitted to mount and fix the tank 18, and has a flow path for guiding the recording liquid supplied from the tank 18 to the recording element substrate unit 400 in its inner part. The recording element substrate unit 400 and the recording element substrate 21 installed therein are provided with a flow path for supplying the recording liquid supplied from the case 500 to a position of each f the energy generating elements 23.

The contact substrate 200 includes a plurality of connection terminals 40. When the liquid discharge head 1 is mounted on the carriage 2, the connection terminals 40 of the contact substrate 200 electrically contact connection terminals on the side of the carriage 2, and electrical conduction to a control substrate 102 (see FIG. 3) in the main body 101 in the liquid discharge apparatus 100 is established. The main body control unit 28 provided in the main body 101 of the liquid discharge apparatus 100 is provided on the control substrate 102. The memory 25 is formed as a semiconductor integrated circuit chip separate from the recording element substrate 21, is installed on a reverse surface, i.e., a surface facing the case 500 of the contact substrate 200, and is stored in a trench-shaped groove provided in the case 500.

The recording element substrate 21 includes the plurality of energy generating elements 23 for generating energy for discharging the recording liquid from the discharge ports of the liquid discharge head 1, described above. The recording element substrate 21 includes a driving circuit 24 including transistors and logic circuits for driving the energy generating elements 23, and is configured as a semiconductor integrated circuit chip including the energy generating elements 23 and the driving circuit 24. An example of the energy generating element 23 is a heater capable of converting an electric signal into heat. Film boiling is generated in the recording liquid by driving of the heater, and its pressure enables the recording liquid to be discharged from the discharge port provided in the vicinity of the heater. Alternatively, a piezoelectric element, which can be mechanically deformed according to an electric signal and exerts an effect of the deformation on the recording liquid to discharge the recording liquid from the discharge port, can also be used as the energy generating element 23. In any case, the energy generating element 23 is driven according to the electric signal to give energy for the discharge to the liquid such as the recording liquid.

In the liquid discharge apparatus 100, the liquid discharge head 1 receives a signal generated by the main body control unit 28 provided in the main body 101, and is driven based on the received signal. At this time, in the liquid discharge head 1, electric power and a signal from the main body 101 are supplied to the recording element substrate 21 via the connection terminals 40 of the contact substrate 200. The driving circuit 24 generates an electric signal to be applied to each of the energy generating elements 23 so that driving control is performed according to the signal transmitted from the main body 101, and recording is performed according to record data included in the signal.

Figure 3:
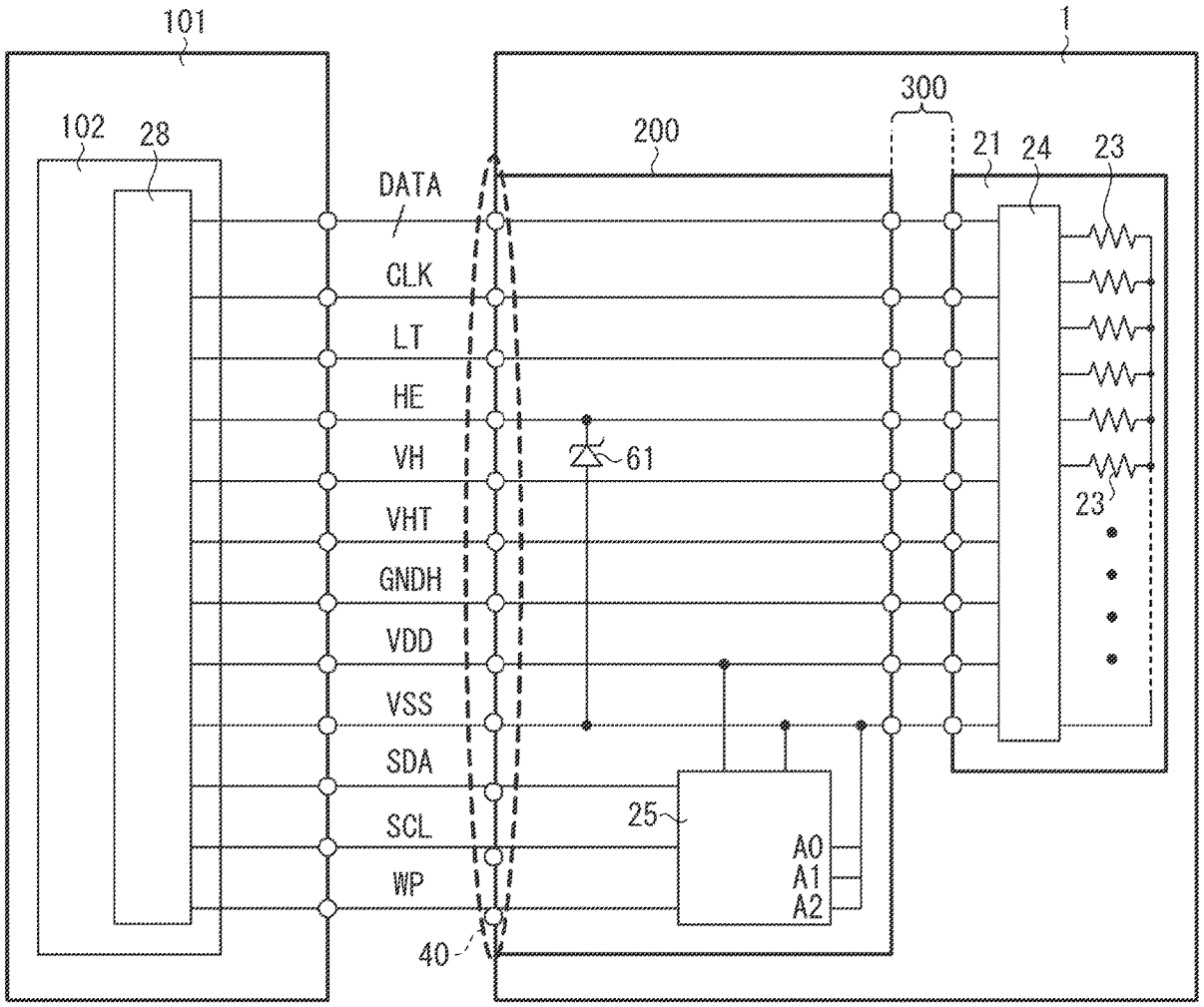
FIG. 3 is a block diagram illustrating a configuration of a liquid discharge head according to a first exemplary embodiment of the present disclosure.

FIG. 3 illustrates a configuration of the liquid discharge head 1 and particularly a wiring line configuration between the main body 101 of the liquid discharge apparatus 100 and the liquid discharge head 1. The connection terminals 40 on the contact substrate 200 are roughly classified into connection terminals for power supply and connection terminals for signal transmission, i.e., signal terminals. The connection terminals for power supply include a power source terminal VH and a grounding terminal GNDH for energy generating elements 23, a power source terminal VHT for transistors, and a power source terminal VDD and a grounding terminal VSS for logic circuits. All the connection terminals for power supply are electrically connected to the driving circuit 24 on the recording element substrate 21. The signal terminals include a data terminal DATA for record data, a clock signal terminal CLK, a latch signal terminal LT, and a heat signal terminal HE, and are electrically connected to the driving circuit 24. The signal terminals not connected to the driving circuit 24 include a data signal terminal SDA, a clock terminal SOL, and a write-protect terminal WP, which are all for the memory 25. For the purpose of illustration, an abbreviation consisting of two to four alphabetical letters is assigned to each of the connection terminals 40. However, a wiring line connected to each of the connection terminals 40 and a potential and a signal supplied to the connection terminal are respectively assigned the same abbreviations as those assigned to the connection terminal 40. Particularly, the wiring line connected to the signal terminal is referred to as a signal wiring line.

First, each of the power source terminals and the grounding terminals will be described. The power source terminal VH is a power source for driving the energy generating elements 23, and a voltage of 24 V, for example, is applied thereto. The power source terminal VHT is a power source for driving the transistor provided to drive each of the energy generating elements 23, and a voltage of 24 V, for example, is applied thereto. A voltage of 3.3 V, for example, is applied to the power source terminal VDD for the logic circuits. The grounding terminal GNDH is a terminal serving as a common ground of the energy generating elements 23. On the other hand, the grounding terminal VSS is a terminal serving as a common ground of the logic circuits included in the driving circuit 24 while applying a reference potential in the drive circuit 24, and is electrically connected to a base material of the recording element substrate 21. Therefore, a relatively larger electric capacitance than that of the other connection terminals among the connection terminals 40 is equivalently connected to the grounding terminal VSS.

The signal terminals will be described below. The data terminal DATA is a terminal to which record data for turning on and off each of the energy generating elements 23 is transferred as serial data. The clock signal terminal CLK is a terminal for transferring a clock signal for synchronizing the transfer of the record data input to the data terminal DATA. The latch signal terminal LT is a terminal for transferring a latch signal (LT signal) serving as a trigger to move the record data to a hold circuit in the driving circuit 24 within the recording element substrate 21. The heat signal terminal HE is a terminal for transferring a pulse signal (heat enable signal (HE signal)) for controlling a time period during which a power source voltage VH is applied to each of the energy generating elements 23 based on a pulse width.

The flow of driving control for the energy generating elements 23 according to signals input to the signal terminals is as follows. First, the record data input via the data terminal DATA is transferred to a shift register circuit (not illustrated) in the driving circuit 24 on the recording element substrate 21 in synchronization with a clock signal (CLK signal). A data group input to the shift register circuit is held in a latch circuit (not illustrated) in the driving circuit 24 by input of the LT signal, and the held data and the HE signal are AND processed to generate a pulse-shaped driving signal. The transistor for driving each of the energy generating elements 23 is turned on and off according to the pulse-shaped driving signal. Thereby, the driving of the energy generating elements 23 is turned on and off.

The memory 25 provided in the contact substrate 200 in the liquid discharge head 1 is, for example, a 12C electrically erasable and programmable read only memory (EEPROM). The data signal terminal SDA is a terminal for writing and reading data to and from the memory 25, and the clock terminal SOL is a terminal using a clock signal for data transfer in the memory 25. The write-protect terminal WP is a terminal for write-protecting the memory 25. While the memory 25 is provided with address terminals A0, A1, and A2, all the address terminals A0, A1, and A2 are connected to the grounding terminal VSS, and are set to 0.

In the present exemplary embodiment, in the contact substrate 200, there is provided a functional element for regulating an applied voltage between a wiring line connected to one or more signal terminals and another wiring line having a relatively larger electric capacitance than that of the wiring line to a predetermined voltage or less. In an illustrated example, in the contact substrate 200, the functional element is connected to connect the wiring line connected to one or more signal terminals and a grounding wiring line VSS connected to the grounding terminal for the logic circuit. As the functional element, a zener diode 61 is connected to have an anode on the side of the signal terminal and a cathode on the side of the grounding terminal VSS The zener diode 61 may be connected between the signal terminal itself and the grounding terminal VSS itself. In the following description, "the zener diode 61 is connected to the terminal" includes a case where the zener diode 61 is connected to the terminal via the wiring line connected to the terminal. There is no restriction on which of the signal terminals the zener diode 61 is connected to. However, the zener diode 61 is provided between the heat signal terminal HE and the grounding terminal VSS, as illustrated in FIG. 3. more specifically, one side and the other side of the zener diode 61 are respectively connected to the heat signal terminal HE and the grounding terminal VSS. If the zener diode 61 is connected to the plurality of signal terminals, the zener diode 61 is provided for each of the signal terminals. The zener diode 61 is mounted on the contact substrate 200 on a reverse surface, i.e., a surface facing the case 500 of the contact substrate 200, like the memory 25. The zener diode 61 is mounted in this way on the contact substrate 200 to prevent the anode and the cathode of the zener diode 61 from being short-circuited by liquid discharged from the discharge ports adhering to a surface of the zener diode 61 in the form of a mist or being deposited in a clearance between the contact substrate 200 and the zener diode 61. A zener voltage of the zener diode 61 is determined according to the amplitude of a signal input to the connected signal terminal or a maximum input voltage allowed for the signal terminal.

If a high surge voltage is applied, for example, to the heat signal terminal HE in such a configuration, a voltage component exceeding the zener voltage can flow out to the grounding wiring line VSS after flowing through the zener diode 61. Therefore, a high voltage is not applied to each of the wiring lines within the liquid discharge head 1, and respective internal insulating films of the recording element substrate 21 serving as a semiconductor substrate and the memory 25 can be avoided being destroyed or damaged. The zener diode 61 connected to the heat signal terminal HE includes one having a higher zener voltage than 3.3 V serving as a power source voltage VSS corresponding to a logic signal, i.e., one having a zener voltage of 6.2 V. In this way, in a heat signal wiring line HE, the corresponding power source voltage VSS is lower than the zener voltage. Therefore, the heat signal wiring line HE and the grounding wiring line VSS become electrically insulated from each other via the zener diode 61. Further, in the recording element substrate 21, a breakdown voltage limit for the heat signal terminal HE is 7 V, and the zener diode 61 to be mounted on includes one having a zener voltage of 7 V or less.

Figure 4A:
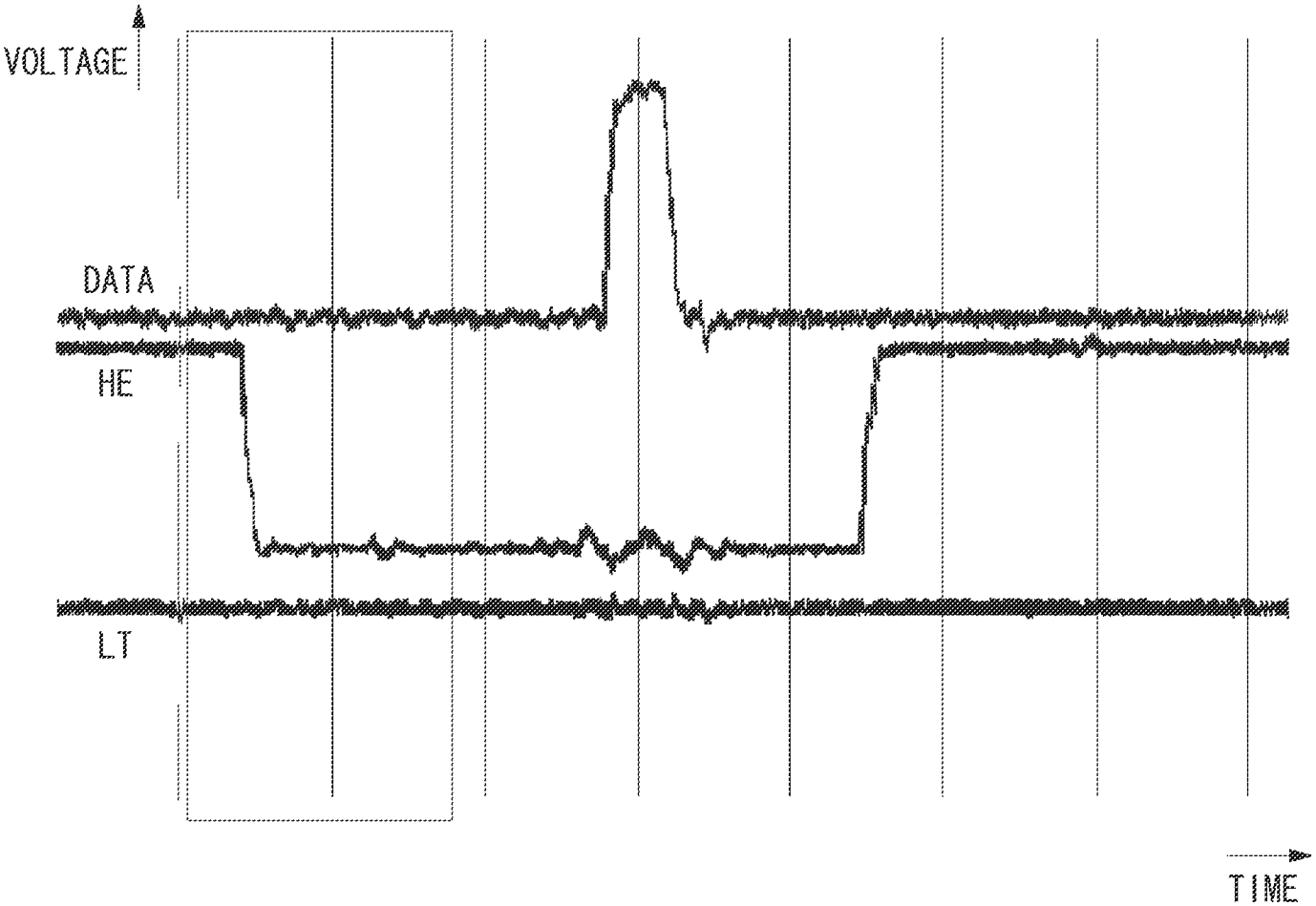
FIGS. 4A to 4C each illustrate an example of a waveform of a driving signal for the liquid discharge head.
Figure 4B:
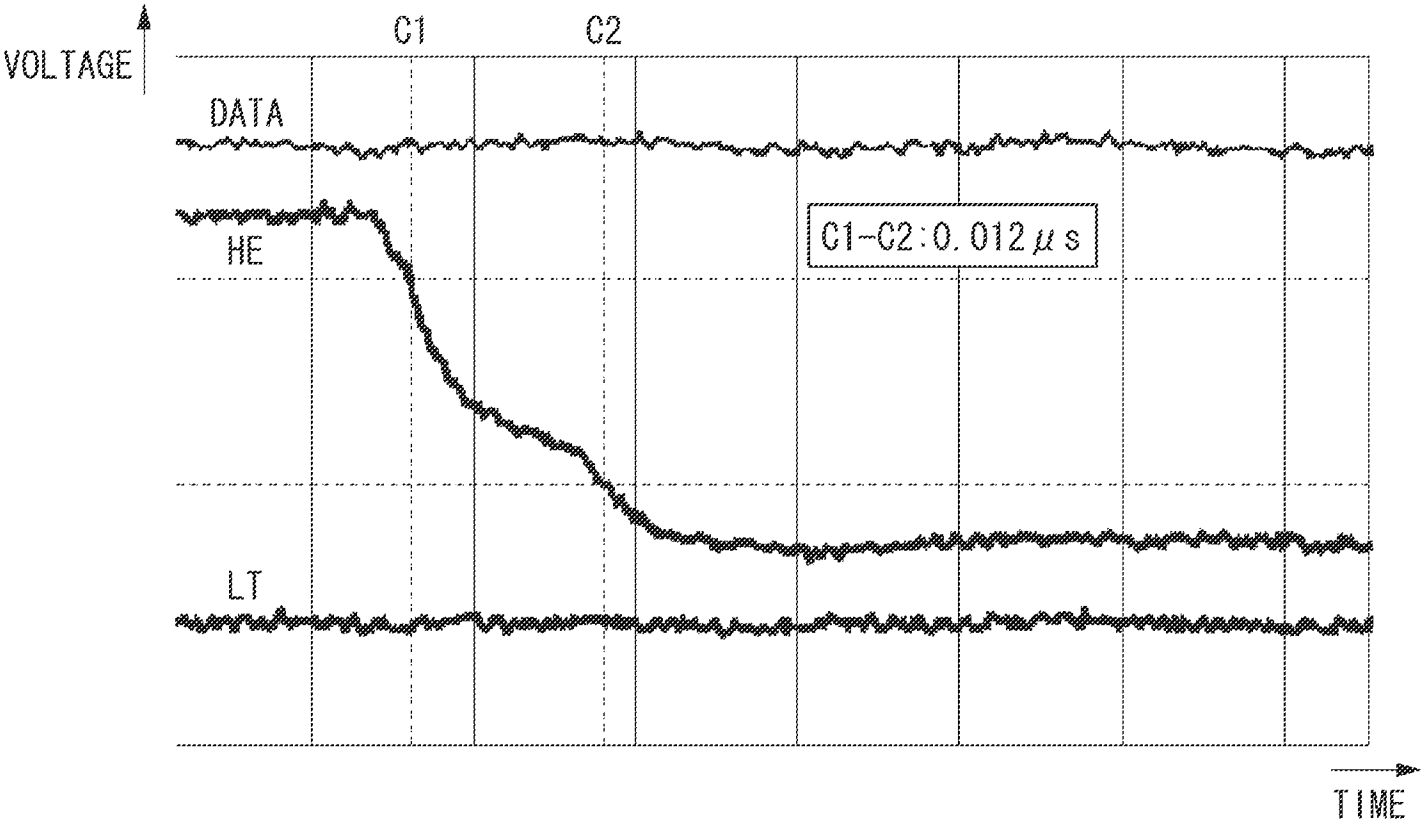
Figure 4C:
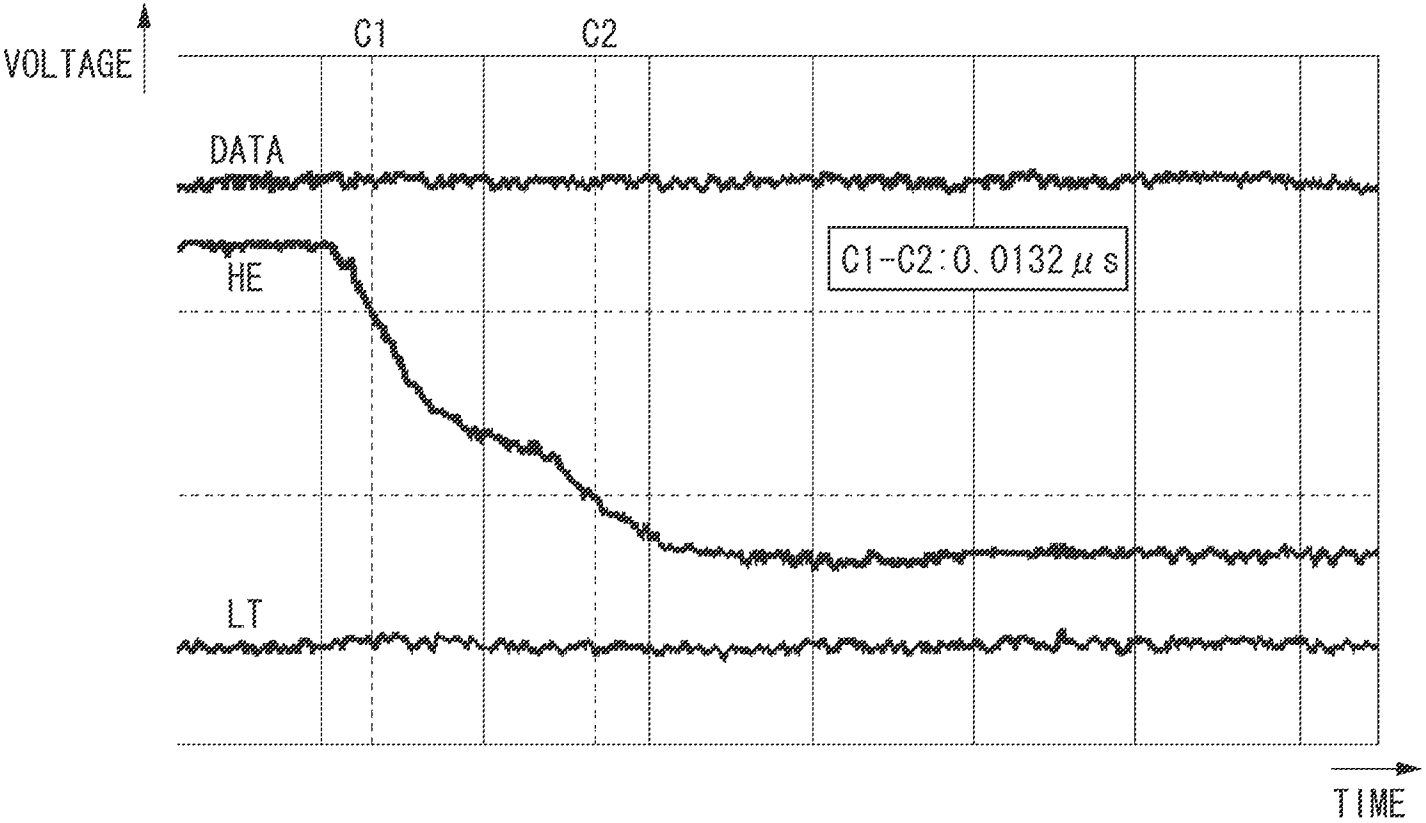

An influence on a parasitic capacitance in the heat signal wiring line HE when the zener diode 61 is connected to the heat signal terminal HE will be described. A terminal capacitance of the heat signal terminal HE and a waveform of the HE signal at the heat signal terminal HE were measured in both cases where the zener diode 61 is and is not connected to the heat signal terminal HE. The terminal capacitance of the heat signal terminal HE was 5 pF when the zener diode 61 is not connected, and was 13.5 pF when the zener diode 61 is connected. FIGS. 4A, 4B, and 4C illustrate a difference in waveform of the HE signal depending on the presence or absence of the zener diode 61. FIG.

4A illustrates an example of a falling waveform of a general HE signal. For reference, waveforms of a data signal (DATA signal) and the LT signal are also illustrated FIG. 4B is an enlarged view of a falling portion when the zener diode 61 is not connected, and FIG. 4C is an enlarged view of the falling portion when the zener diode 61 is connected. In both FIGS. 4B and 4C, a portion enclosed by a frame in FIG. 4A is enlarged with respect to a time axis. A time period during which the HE signal changes from 80% to 20% (time difference between C1 and C2 in FIG. 4) in signal amplitude is defined as a falling time. From FIGS. 4B and 4C, the falling time was 0.012 ps when the zener diode 61 is not provided, and was 0.0132 ps when the zener diode 61 is provided. The difference therebetween is 0.0012 μs. The difference is substantially similar for a rising waveform of the HE signal. A delay of approximately 0.001 μs occurs when a difference in capacitance is 10 pF. In a normal case, a time width of the HE signal is 0.5 to 1.0 μs. Therefore, the difference of the waveform of the HE signal depending on the presence or absence of the zener diode 61 hardly affects driving of the energy generating elements 23.

Calculation values by a circuit simulation were also obtained, and when a similar environment to the environment in the above-described measurement was set, a delay time by addition of the zener diode 61 was 0.0015 μs, and substantially the same result was obtained. However, when an ambient temperature was changed in performing a circuit simulation, a delay time by addition of the zener diode 61 increased to 0.00485 μs in a low-temperature environment. Even in this case, the driving of the energy generating elements 23 can be hardly affected.

Which of the signal terminals the zener diode 61 can be connected to is then considered in consideration of the above-described delay time by the connection of the zener diode 61. A worst value of the delay is approximately 0.005 μs. Thus, a setup/hold time period needs to be approximately 0.05 μs if it requires 10 times of the delay. Therefore, a time width of each pulse is a minimum of 0.1 μs, and is 0.2 μs if it requires one period. 1/0.2 μs=5 MHz. Therefore, a logic signal can be unaffected, even if the zener diode 61 is connected, by the parasitic capacitance the zener diode 61 if the frequency thereof is approximately 5 MHz or less. Among logic signals, the LT signal and the HE signal are lower in speed than the CLK signal and the DATA signal. Therefore, the zener diode 61 can be connected to the latch signal terminal LT and the heat signal terminal HE. If the frequencies of the DATA signal and the CLK signal are 5 MHz or less, the liquid discharge head 1 can be driven, even if the zener diode 61 is connected, without being affected by the parasitic capacitance of the zener diode 61. According to the present exemplary embodiment, the zener diode 61 is connected between the signal terminal HE and the grounding terminal VSS having a large electric capacitance. Thus, even if a high surge voltage is applied, a surge current can be released to the grounding wiring line VSS so that the recording element substrate 21 can be prevented from being damaged.

Figure 5:
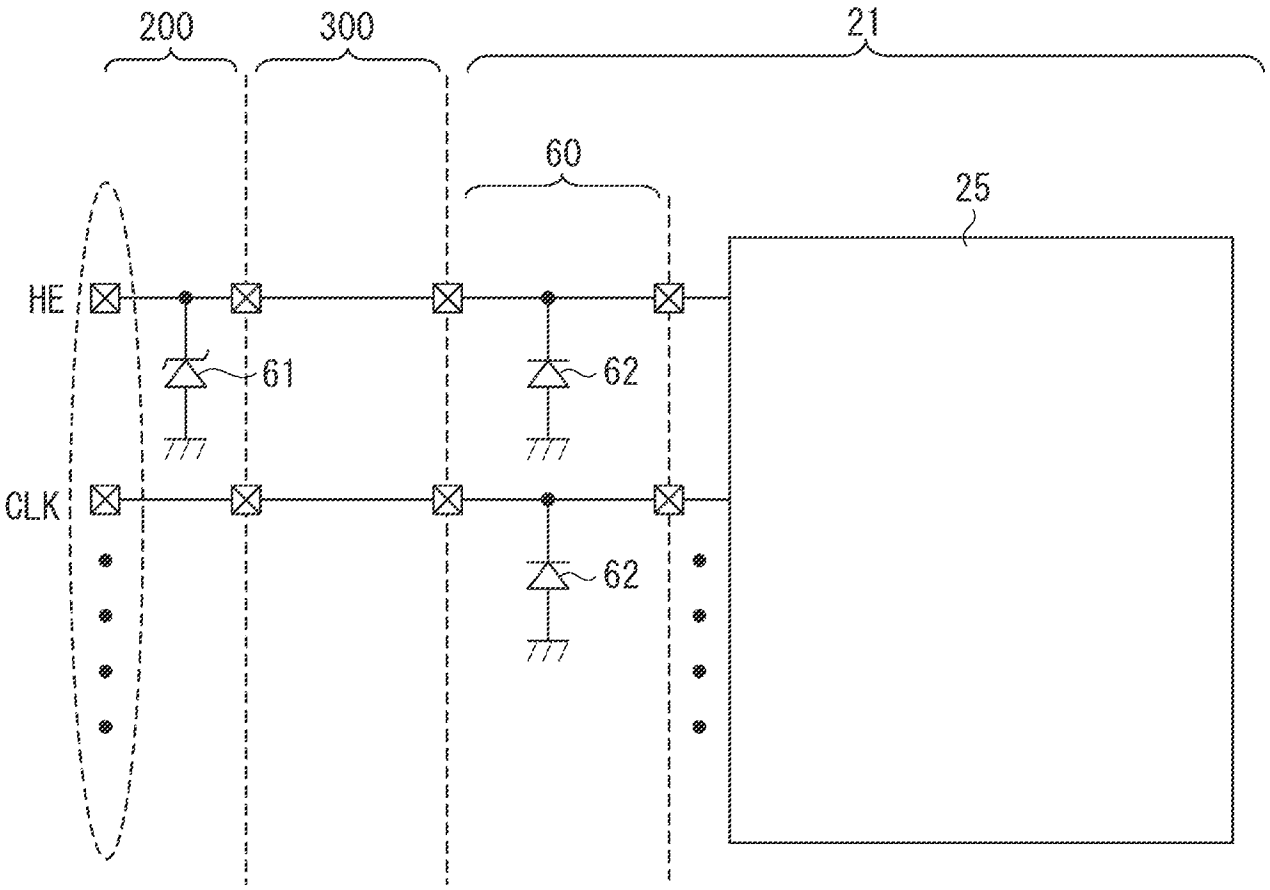
FIG. 5 is a block diagram illustrating a configuration of a liquid discharge head according to a second exemplary embodiment.

While the zener diode 61 provided on the contact substrate 200 provides protection from an electrostatic surge in the first exemplary embodiment, an example in which a protection element is further provided for protection from static electricity will be described in a second exemplary embodiment. FIG. 5 illustrates a configuration of a main part of a liquid discharge head 1 according to the second exemplary embodiment.

In the present exemplary embodiment, in a contact substrate 200, a zener diode 61 is provided between a terminal HE and a grounding terminal VSS, like in the first exemplary embodiment. Further, a diode 62, which breaks down at a predetermined applied voltage or more is provided as a protection element for protection from static electricity for a wiring line HE within a recording element substrate 21. The diode 62 has its cathode connected to the wiring line HE and its anode connected to a wiring line VSS. A position of the diode 62 is preferably within the recording element substrate 21 and at a position significantly close to a connection position with a wiring member 300. More specifically, the position of the diode is preferably provided in a connection portion 60 including a position where the recording element substrate 21 is connected to the wiring member 300 and its vicinity. A breakdown voltage of the diode 62 is 15 V, for example. If a voltage of 15 V or more is applied to the wiring line HE on the recording element substrate 21, a current flows through the grounding wiring line VSS, so that a potential difference between the wiring line HE and the grounding wiring line VSS is suppressed to less than 15 V. In the present exemplary embodiment, a zener diode is not provided on the contact substrate 200 at a signal terminal (e.g., terminal CLK in FIG. 5) other than the terminal HE. However, even at such a logic terminal, the diode 62, which breaks down at a predetermined applied voltage or more, is connected as a protection element to a wiring line corresponding to the logic terminal, like the wiring line HE, within the recording element substrate 21.

When a wiring line length in the wiring member 300 is short, and the impedance thereof is small, a protection element can be provided in the recording element substrate 21. Even in such a case, when the zener diode 61 is provided in the contact substrate 200, energy generating elements 23 and a memory 25 can be more effectively protected from electrostatic surge. A diode, which breaks down at a predetermined applied voltage or more, provided as a protection element on the recording element substrate 21 is preferably provided for not only a signal terminal but also wiring line connected to a connection terminal for power supply, i.e., a power source wiring line. More specifically, a protection element is preferably provided between each of the wiring lines VH, VHT, and VDD and the grounding wiring line VSS. The power source wiring line is extended around a wide range within the recording element substrate 21, so that a wiring line area is large. Therefore, if a high-voltage surge is applied to the power source wiring line, a current from the signal terminals or the energy generating elements 23 may flow through various paths. When a diode serving as a protection element is also provided in the power source wiring line, a surge current caused by a voltage exceeding a breakdown voltage of the diode flows out to the grounding wiring line VSS via the diode. Therefore, even if the high-voltage surge is applied to the power source wiring line, the recording element substrate 21 can be prevented from being destroyed. A breakdown voltage of the diode connected to the wiring lines VH and VET may be approximately 40 V. A voltage of 24 V is normally applied to the wiring lines VH and VHT, and is lower than the breakdown voltage of the diode. Therefore, each of the wiring lines VH and VET and the grounding wiring line VSS are electrically insulated from each other via the diode at the normal time.

In the above-described first and second exemplary embodiments, the zener diode 61 included in the contact substrate 200 is preferably provided only between the terminal HE and the terminal VSS from the following reason. In recent years, as a demand for high-speed recording has increased, the driving frequency of the liquid discharge head 1 has been improved, and the transfer speed of the record data has also been improved. Therefore, the respective frequencies of the CLK signal and the DATA signal are generally set to 10 MHz or more. When the pulse width of the LT signal is increased, margins in the CLK signal and the DATA signal are reduced. Therefore, a delay in the LT signal is not preferable. On the other hand, the HE signal is not switched at a more precise timing than the DATA signal and the LT signal. Therefore, a margin in the HE signal is large for a signal delay. Thus, in the contact substrate 200, the zener diode 61 is preferably provided not at the terminals CLK, DATA, and LT but between the terminal HE and the terminal VSS.

While the zener diode is used as a functional element provided on the contact substrate 200 in each of the above-described exemplary embodiments, the zener diode may be replaced with a varistor. A configuration in which the contact substrate 200 is not provided and the wiring member 300 itself is provided with a connection terminal 40 instead thereof can be used as a variation of the configuration of the liquid discharge head 1 (not illustrated). For example, there may be a configuration in which an insulating film on a surface of the wiring member 300 is provided with a plurality of openings, to expose an internal wiring line as a terminal, if the wiring member 300 includes a flexible wiring line board, and the exposed terminal is used as a connection terminal for connection with the main body 101 in the liquid discharge apparatus 100. At this time, the functional element such as the zener diode is connected, after the insulating film on the surface of the wiring member 300 is provided with the opening, to expose the inner wiring line, to the exposed wiring line.

According to the exemplary embodiment described above, a functional element, for regulating an applied voltage, is arranged between a signal wiring line and another wiring line having a relatively large electric capacitance. Therefore, even if a high-voltage electrostatic surge is applied to the signal wiring line, a surge current can be released to a wiring line having a large electric capacitance. In this way, a driving circuit within a recording element substrate can be inhibited from being damaged.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-146274, filed Jul. 26, 2016, which is hereby incorporated by reference herein in its entirety.

What is claimed is:

1. A liquid discharge head, comprising:

a recording element substrate including an energy generating element configured to generate energy for discharging liquid and a driving circuit configured to drive the energy generating element; and a wiring unit including a plurality of connection terminals for establishing electrical connection with a liquid discharge apparatus including the liquid discharge head and electrically connected to the recording element substrate, wherein in the wiring unit, wiring lines are respectively connected with the plurality of connection terminals, and a functional element configured to regulate an applied voltage to a predetermined voltage or less is connected between at least one of signal wiring lines connected to the driving circuit and used to transmit a signal for driving the energy generating element among the wiring lines and a wiring line having a relatively larger electric capacitance than that of the signal wiring line, and wherein the functional element is not connected to a power wiring line for driving the energy generating element among the wiring lines.

2. The liquid discharge head according to claim 1, wherein the wiring unit includes a contact substrate having the plurality of connection terminals formed therein and a wiring member configured to connect the contact substrate and the recording element substrate to each other, and the functional element on provided in the contact substrate.

3. The liquid discharge head according to claim 1, wherein the recording element substrate is formed of a semiconductor substrate, and a protection element configured to provide protection from static electricity is provided between at least one of the wiring lines and a grounding wiring line in a connection unit configured to make connection with the wiring unit in the recording element substrate.

4. The liquid discharge head according to claim 1, wherein the functional element is provided for the wiring line driven at a frequency of 5 MHz or less.

5. The liquid discharge head according to claim 1, wherein the functional element is provided for the signal wiring line configured to control a pulse for driving the energy generating element.

6. The liquid discharge head according to claim 1, wherein the wiring line having a relatively large electric capacitance is a grounding wiring line electrically connected to a base material of the recording element substrate.

7. The liquid discharge head according to claim 1, wherein the functional element is a zener diode.

8. A liquid discharge head, comprising:

a recording element substrate including an energy generating element configured to generate energy for discharging liquid and a driving circuit configured to drive the energy generating element; and a wiring unit including at least one signal wiring line connected to the driving circuit and used to transmit a signal for driving the energy generating element, a grounding wiring line having a relatively larger electric capacitance than that of the signal wiring line, and a functional element configured to connect the at least one signal wiring line and the grounding wiring line to each other to regulate an applied voltage to a predetermined voltage or less, and wherein the functional element is not connected to a power wiring line for driving the energy generating element among the wiring lines.

9. The liquid discharge head according to claim 8, wherein the functional element is a zener diode.

10. A liquid discharge head, comprising:

a recording element substrate including an energy generating element configured to generate energy for discharging liquid and a driving circuit configured to drive the energy generating element; and a wiring unit including at least one signal terminal connected to the driving circuit and used to transmit a signal for driving the energy generating element, a grounding terminal having a relatively larger electric capacitance than that of the signal terminal, and a functional element configured to connect the at least one signal terminal and the grounding terminal to each other and regulate an applied voltage to a predetermined voltage or less, and wherein the functional element is not connected to a power wiring line for driving the energy generating element among the wiring lines.

11. The liquid discharge head according to claim 10, wherein the functional element is a zener diode.

* * * * *